US009683750B2

(12) United States Patent
Montirosso

(10) Patent No.: US 9,683,750 B2
(45) Date of Patent: Jun. 20, 2017

(54) MOUNTING PLATE

(71) Applicant: Red Rock Industries Pty Ltd, Thornbury (AU)

(72) Inventor: Robert Montirosso, Thornbury (AU)

(73) Assignee: Red Rock Industries Pty Ltd, Thornbury (AU)

( * ) Notice: Subject to any disclaimer, the term of this patent is extended or adjusted under 35 U.S.C. 154(b) by 0 days.

(21) Appl. No.: 14/467,205

(22) Filed: Aug. 25, 2014

(65) Prior Publication Data

US 2015/0059391 A1 Mar. 5, 2015

(30) Foreign Application Priority Data

Aug. 27, 2013 (AU) ..... 2013905106

(51) Int. Cl.

| | |
|---|---|
| ***F24F 1/34*** | (2011.01) |
| ***F24F 1/02*** | (2011.01) |
| ***F25B 49/02*** | (2006.01) |
| ***F24F 1/00*** | (2011.01) |
| ***F24F 1/32*** | (2011.01) |

(52) U.S. Cl.

CPC ..... *F24F 1/027* (2013.01); *F24F 1/0007* (2013.01); *F24F 1/32* (2013.01); *F24F 1/34* (2013.01); *F25B 49/02* (2013.01); *F24F 2001/0048* (2013.01); *F24F 2221/17* (2013.01); *Y10T 29/49627* (2015.01); *Y10T 29/49826* (2015.01)

(58) Field of Classification Search

CPC ... F24F 1/34; F24F 2221/17; F24F 2001/0048
See application file for complete search history.

(56) References Cited

U.S. PATENT DOCUMENTS

| | | | | |
|---|---|---|---|---|
| 1,569,782 | A * | 1/1926 | Otto et al. | 236/1 R |
| 3,438,219 | A * | 4/1969 | Brugler | 62/262 |
| 3,848,897 | A * | 11/1974 | McClellan | 285/47 |
| 4,811,570 | A * | 3/1989 | Jennings et al. | 62/263 |
| 7,305,801 | B2 * | 12/2007 | Gilleran | 52/220.8 |
| 7,834,267 | B1 * | 11/2010 | Gretz | 174/66 |
| 2002/0184909 | A1 * | 12/2002 | Hobbs et al. | 62/263 |
| 2010/0270071 | A1 * | 10/2010 | Plankell | 174/502 |
| 2011/0042515 | A1 * | 2/2011 | Schoke et al. | 244/129.2 |
| 2012/0100319 | A1 * | 4/2012 | Keller | A62C 2/06 428/34.5 |

FOREIGN PATENT DOCUMENTS

JP 2004156879 A 6/2004

OTHER PUBLICATIONS

Search Report issued Feb. 24, 2015 in European Application No. 14182158.

* cited by examiner

*Primary Examiner* — Kristina N Junge
(74) *Attorney, Agent, or Firm* — Kim Winston, LLP

(57) ABSTRACT

Disclosed herein is a mounting plate for an air conditioning unit. The mounting plate comprises a first side for attachment to a wall, a second side on which the air conditioning unit is mountable, and a housing on the first side that is positionable within a cavity in the wall, the housing being adapted to house piping for attachment to the air conditioning unit.

22 Claims, 12 Drawing Sheets

MOUNTING PLATE

CROSS-REFERENCE TO RELATED APPLICATION

This application claims priority to Australian Application No. 2013905106 filed Aug. 27, 2013, the disclosure of which is hereby incorporated by reference in its entirety.

TECHNICAL FIELD

The invention relates to a mounting plate and, in one form, a mounting plate for installing an air conditioning unit.

BACKGROUND ART

Construction of buildings, particularly high-rise buildings and apartments, requires the involvement of multiple trades people.

People who install dual unit air conditioners usually need to be present on site a number of times. Generally, on their first visit, they install the necessary piping into the cavities between wall studs in the walls and in the roof. The piping is then left, usually hanging and exposed from a wall stud because the installers need to wait for other trades people (e.g. plasterers, builders and painters) to finish their parts of the construction process. Often, the exposed pipes can be damaged by the builders or other trades people.

Once the wall boards (which are typically formed of plaster) are installed on the wall studs, the air conditioner installer then returns to complete the installation process. They must first determine the ideal location for the air conditioner according to the location of the piping and the wall studs. Locating the wall studs is usually relatively straightforward—the installer may, for example, use a stud finder or tap on the wall boards with their knuckles until the position of the wall studs has been ascertained. However, locating the piping can often require guesswork as it will often have been completely covered by the wall boards. This may lead to an installer scoring or damaging the wall boards a numbers of times before the piping is located.

SUMMARY OF INVENTION

In a first aspect, the present invention provides a mounting plate for an air conditioning unit. The mounting plate comprises a first side for attachment to a wall (e.g. to one or more wall studs in the wall), a second side on which the air conditioning unit is mountable, and a housing on the first side that is positionable within a cavity in the wall, the housing being adapted to house piping for attachment to the air conditioning unit.

Advantageously, the mounting plate of the present invention can enable piping to be housed whereby it can be substantially protected during construction. For example, as the piping can be housed within the housing, it would not be necessary to leave the piping hanging from a wall stud, where it could inadvertently be damaged (e.g. when installing wall boards).

The mounting plate of the present invention may also help the installer to locate where the air conditioning unit is to be mounted, as it is significantly larger than the wall studs and therefore easier to locate in the event that the wall boards cover the entire wall. The mounting plate of the present invention also provides a much greater surface area onto which the air conditioning unit can be attached, compared with wall studs (which are typically relatively narrow).

Furthermore, as the mounting plate typically spans a number of wall studs, the relative position of the mounting plate with respect to the wall studs (in embodiments where the mounting plate is being affixed to the wall studs) can be varied. In contrast, the position at which an air conditioning unit can be mounted in the absence of a mounting plate is dependent on the location of the attachment points on the unit and the wall studs being aligned (which may, for example, not enable the air conditioning unit to be centrally located on a wall).

In one form, the housing may comprise a wall which extends from the first side of the mounting plate. In one form, the housing may comprise a base and a plurality of side walls extending from the first side to the base.

In one form, the housing may comprise a chamber into which the piping is receivable.

In one form, the mounting plate may comprise an access window via which piping housed inside the housing can be accessed from the second side of the mounting plate.

In one form, the access window may be covered by wall boards during construction of the wall, with the installer subsequently needing to cut into the wall board over the access window in order to access the housing. In an alternate form, the mounting plate may comprise a cover that is removable to expose the access window. An advantage of the cover can be that it can provide a visual aid during the installation of the wall boards to ensure that access to the access window (and housing) is not hindered. Once such wall boards are installed, the cover may also provide a reference point for the installer to identify the location at which the air conditioning unit is to be mounted.

In one form, the cover may also extend over a portion of the second side in addition to the access window. This portion is typically an area of the second side that is covered by the cover such that an installer is warned not to install wall boards over the additional portion as well as the access window. In one form, for example, a backing plate may be provided on the second side of the mounting plate, where the backing plate limits the space between the air conditioning unit and the mounting plate to the same degree as the surrounding installed wall boards. This can ensure that the air conditioning unit is mounted on a substantially even surface (i.e. in embodiments where the wall boards do not completely cover the mounting plate).

In one form, the mounting plate may comprise fire resistant material which resists the spread of fire through the mounting plate (i.e. from the first side of the mounting plate to the second side and vice versa). As will be appreciated, including fire resistant material may help prevent the spread of fire, smoke or chemicals from one room to another. In one form, the housing may comprise a fire resistant expandable foam. In one form, the fire resistant expandable foam is expandable graphite. In one form, the expandable foam can be located at an opening of the housing.

In one form, the housing may comprise a fire resistant board. In one form, an interior of the housing may comprise a layer of the fire resistant board. In one form, the fire resistant board is a calcium silicate board.

In one form, the housing may be adapted to be positionable within a cavity defined between adjacent wall studs. Alternatively, the housing may be adapted to be positionable within a cavity which spans one or more wall studs.

In a second aspect, the present invention provides a method of installing an air conditioning unit. The method comprises:

a. attaching a mounting plate to one or more wall studs in a wall, the mounting plate comprising a first side which comprises a housing that is positionable within a cavity in the wall (e.g. a cavity between the wall studs), a second side, and an access window, via which an interior of the housing can be accessed from the second side;

b. placing piping for the air conditioning unit into the housing;

c. connecting wall boards to the wall studs;

d. accessing the piping via the access window and connecting the piping to the air conditioning unit; and e. mounting the air conditioning unit to the second side of the mounting plate.

In one form, the wall boards are connected to the wall studs whilst leaving the access window exposed. In such a form, the method may further comprise positioning a removable cover over the access window prior to connecting the wall boards to the wall studs. The cover may be removed prior to accessing the piping via the access window and connecting the piping to the air conditioning unit.

In one form, accessing the piping via the access window comprises cutting an aperture in the wall boards to expose the access window.

In one form, the mounting plate used in the method of the second aspect of the present invention is the mounting plate of the first aspect of the present invention.

It will be appreciated that any of the features described herein can be used in any combination, and that the mounting plate used in the method of the second aspect of the present invention may have the specific features referred to above in respect of the mounting plate of the first aspect of the present invention.

BRIEF DESCRIPTION OF DRAWINGS

Specific embodiments of the invention will now be described below with reference to the accompanying drawings in which.

DESCRIPTION OF EMBODIMENTS

Figure 1:
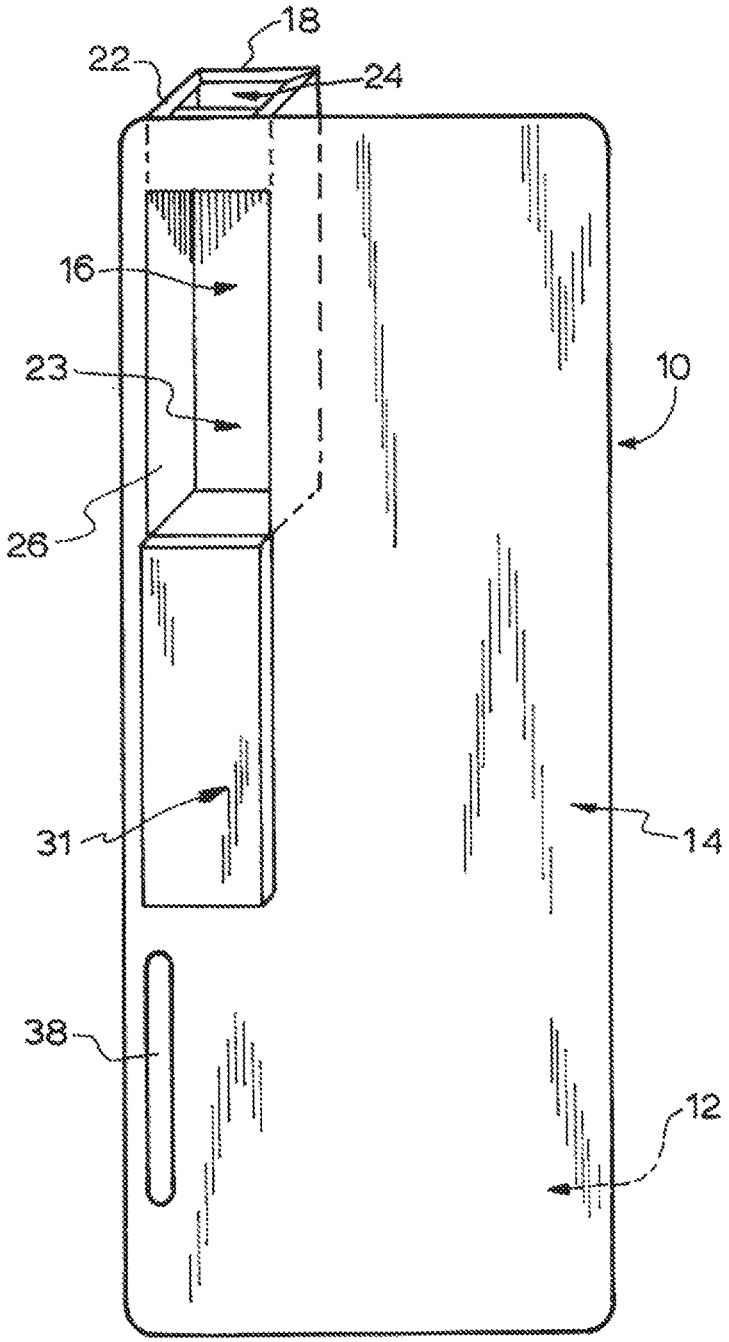
FIG. 1 is a perspective view of a second side of a mounting plate in accordance with an embodiment of the invention.
Figure 2:
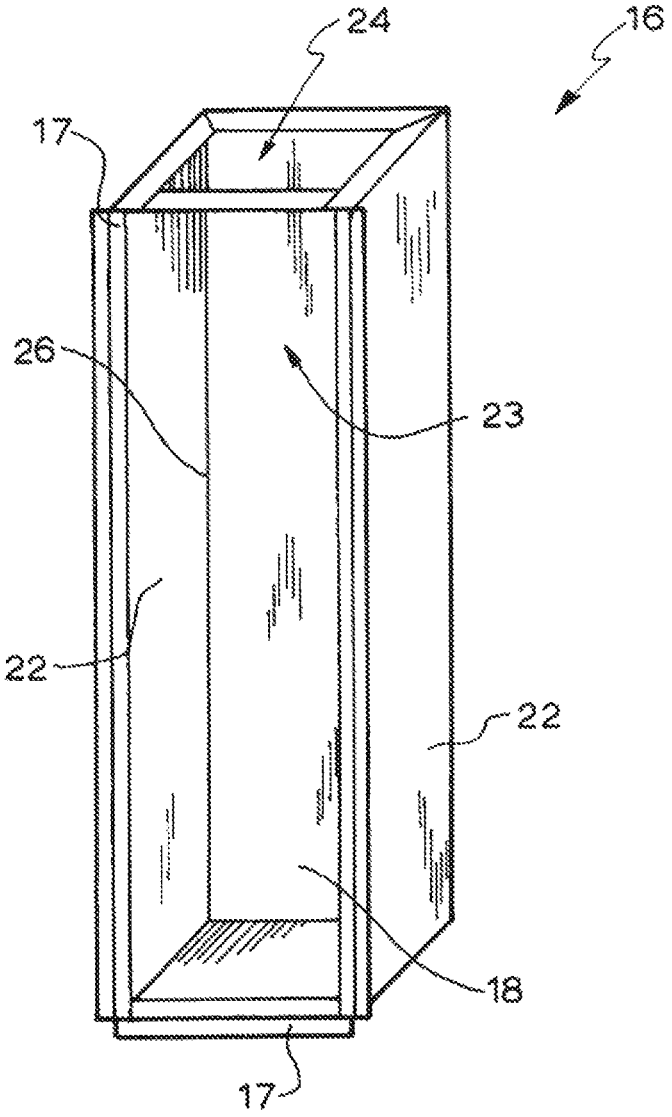
FIG. 2 is a more detailed view of a housing of the mounting plate of FIG. 1.
Figure 3:
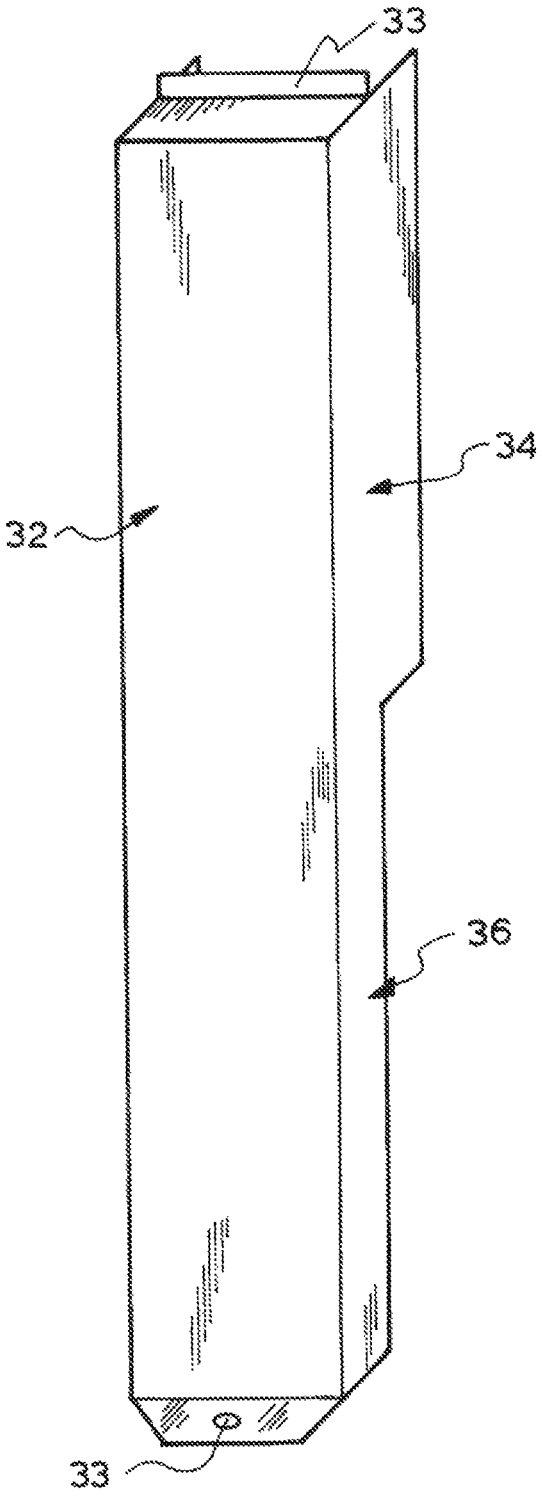
FIG. 3 is a perspective view of a cover that can be used with the mounting plate of FIG. 1.

The present invention provides a mounting plate for an air conditioning unit, such as a dual (or 'split') air conditioning unit. The mounting plate has a first side for attaching to a wall (e.g. to one or more wall studs in the wall) and a second side on which the air conditioning unit is mountable thereon. The mounting plate also has a housing on the first side that is positionable within a cavity in the wall and is adapted to house piping for attachment to the air conditioning unit.

As will be appreciated, walls of buildings are often formed using a plurality of wall studs to provide strength and form to the wall, and which are subsequently covered on both sides by wall boards. The wall boards define a space therebetween, which is commonly used to house electrical wiring, piping and the like. In the present invention, the housing of the mounting plate is positionable within a cavity in the space between the wall boards.

The housing may be adapted to be positioned within a cavity defined between adjacent wall studs. Typically, this will involve the housing having dimensions not exceeding those of the cavity (i.e. a length less than the distance between the adjacent wall studs and a width less than the distance between the opposing wall boards). As will be appreciated, such embodiments will enable an installer to easily fit the mounting plate to an existing wall. However, the location at which the mounting plate can be attached to the wall may be limited by the locations of the wall studs, and smaller housings may not be able to comfortably house the entire length of piping for attachment to the air conditioning unit.

Alternatively, the housing may be adapted to be positioned within a cavity which spans one or more wall studs. Thus, if the desired position for the mounting plate is impeded by the location of the wall studs (for example, the housing would make physical contact with a wall stud and therefore not be able to fit into the space between the wall boards), the installer can consider carving an appropriate portion out of the wall stud to accommodate the housing (and, if necessary, providing a complementary constricted portion in the housing). Alternatively, the configuration of the wall studs in the wall can be predesigned to accommodate the housing. For example, vertically orientated wall studs could be cut at a certain height and capped by a sill trimmer and head trimmer, with the sill and head trimmers defining therebetween a gap into which the housing may be received. In some embodiments, the housing itself may support the vertically orientated wall studs such that no sill and head trimmers would be required.

The mounting plate is typically adapted for attachment to one or more wall studs in the wall because air conditioning units are relatively heavy and wall boards may not be strong enough to support them. However, in some embodiments, the mounting plate may be attached to the wall boards, for example via a number of attachment points spaced all over the first side.

The first side can have a surface that complements the surface of the wall boards or the wall studs to which it is to be attached. For example, the first side can have a planar surface that complements the planar surface of the wall boards or the wall studs. The mounting plate can have, for example, holes which extend between first and second sides and can receive connectors such as bolts, nails, screws etc.

to connect the mounting plate to the wall boards or the wall studs. Alternatively (or in addition), the first side may have protrusions adapted to engage the wall board or wall stud and thereby attach the mounting plate to the wall. As will be appreciated, providing a large number of such holes, protrusions, etc. will give the installer a high degree of flexibility to install the mounting plate at a desired location, notwithstanding the position of wall studs. The more of such holes, protrusions, etc. provided increases the likelihood of a sufficient number of these attachment points aligning with wall studs so that the mounting plate can be securely attached to the wall.

The second side can be sized and shaped to receive and support the air conditioning unit that is mounted thereon. For example, the second side can have a planar surface that complements the rear of an air conditioning unit or an intermediary portion connecting the air conditioning unit to the mounting plate. The intermediary portion can be a bracket used conventionally for installing split air conditioning units to wall boards.

The mounting plate also has a housing which is adapted to house piping or other features, such as electrical wires or the like, that are required by the air conditioning unit. The housing can be adapted so as to securely house the piping during, for example, the construction of a high-rise building and prevent the piping from inadvertent removal from the housing.

The housing may be any structure that can house the piping (etc.) required by the air conditioning unit. In one example, the housing has a chamber in which the piping is received. The chamber can be defined by walls including a base and a plurality of side walls. The housing can comprise an opening to the chamber to receive the piping.

The mounting plate can also comprise an access window via which a user can access piping housed inside the housing from the second side. Alternatively, the mounting plate may have a portion able to be relatively easily cut out post-installation in order to access the piping stored in the housing from the second side (i.e. from the room in which the air conditioner is to be installed).

The access window may be covered by wall boards during construction of the wall, with the installer simply cutting out the portion of the wall board covering the access window in order to access the housing when the air conditioning unit is to be installed. As will be appreciated, once installed, the wall boards would provide excellent protection for the tubing housed in the housing. The access window could easily be found under the wall boards by tapping the wall boards or by using tools routinely used in the art.

Alternatively, the mounting plate can have a cover. The cover can be removable. The cover can assist in protecting the piping housed in the housing and also assist in ensuring that the wall boards do not cover the access window and hinder access to the piping. The cover can also extend over a portion of the second side to prevent the installed wall board unintentionally limiting the size of the portion required to connect the air conditioning unit thereto. The portion can define the location at which the air conditioning unit is affixable. Alternatively, the portion can be a backing plate.

It is preferable that the surface provided by the mounting plate and the wall boards creates an even surface for the mounting of the air conditioning unit. The backing plate can assist in providing such an even surface, For example, the portion of the second side is typically an area of the second side that is covered by the cover such that an installer cannot install wall boards as required. This can create an uneven surface. Where a backing plate is used, the backing plate can advantageously act as a 'substitute' for the wall boards the installer cannot install as required. In doing so, the backing plate limits the space between the air conditioning unit and the mounting plate to the same degree as the surrounding installed wall boards. This can ensure that the air conditioning unit is placed on a substantially even surface.

The backing plate can be permanently or removably fixed to the mounting plate. The backing plate can be connected to the second side of the mounting plate. The backing plate can be of a thickness, and formed of a material, that is substantially consistent with the thickness and material of the wall boards used during the construction process. In doing so, once the wall boards are installed, the backing plate is at a level flush with the surrounding wall boards. In one example, where the wall boards are formed of 10 mm thick plaster, the backing plate can also be formed of 10 mm thick plaster. In another example where the wall boards are made of fire retardant material, the backing plate can also be formed of fire retardant material. The backing plate can be formed of single or multiple layers of material (fire retardant or non fire retardant material) to correspond with the thickness of the surrounding wall boards.

The mounting plate can also have an aperture (e.g. in addition to the access window) to allow one or more cables or electrical wires to be threaded through. The aperture can act as a reference point for the electrical fit off for the air conditioning unit.

The mounting plate can be substantially fire resistant to prevent the piping acting as a conduit for fire, chemicals or smoke between, for example, apartments in a high-rise building. The housing of the mounting plate can be formed of, coated with, contain or be layered with fire resistant material. In one example, the housing can have a fire resistant expandable foam. The expandable foam can be intumescent or expandable graphite. The expandable foam can be located at an opening of the housing. The expandable foam can be connected to the housing via a suitable adhesive. The housing can also have a fire resistant board. The fire resistant board can be formed of a fire resistant material such as calcium silicate sheet. The interior of the housing can have a layer of the fire resistant board. The fire resistant board can be connected to the housing via a suitable adhesive.

Embodiments of the present invention also provide a method of installing an air conditioning unit. The method includes attaching a mounting plate to one or more wall studs. The mounting plate comprises a housing on a first side of the mounting plate that is positionable between the wall studs and a second side, which has an access window via which an interior of the housing can be accessed. Piping for the air conditioning unit is then placed into the housing. Wall boards are then installed to the wall studs. The pipes are accessed via the access window and connected to the air conditioning unit. The air conditioning unit can then be mounted to the mounting plate.

In one example, the wall boards are connected to the wall studs whilst leaving the access window exposed. In such a form, the method may further comprise positioning a removable cover over the access window prior to connecting the wall boards to the wall studs. The cover may be removed prior to accessing the piping via the access window and connecting the piping to the air conditioning unit.

In one example, accessing the piping via the access window comprises cutting an aperture in the wall boards to expose the access window.

Specific embodiments of the invention will now be described with reference to the accompanying drawings.

A mounting plate 10 for an air conditioning unit is shown in FIGS. 1 to 4. The mounting plate 10 has a first side 12 adapted for attaching to a wall. In this example, the wall has wall studs 7 and wall boards 8 (see FIG. 4). In this embodiment the first side 12 is attached to wall studs 7 via screws 15. The mounting plate 10 also has a second side 14 (see, for example, FIG. 1) on which the air conditioning unit (not shown) is mountable thereon. The second side 14 is connected to wall boards 8.

Figure 4:
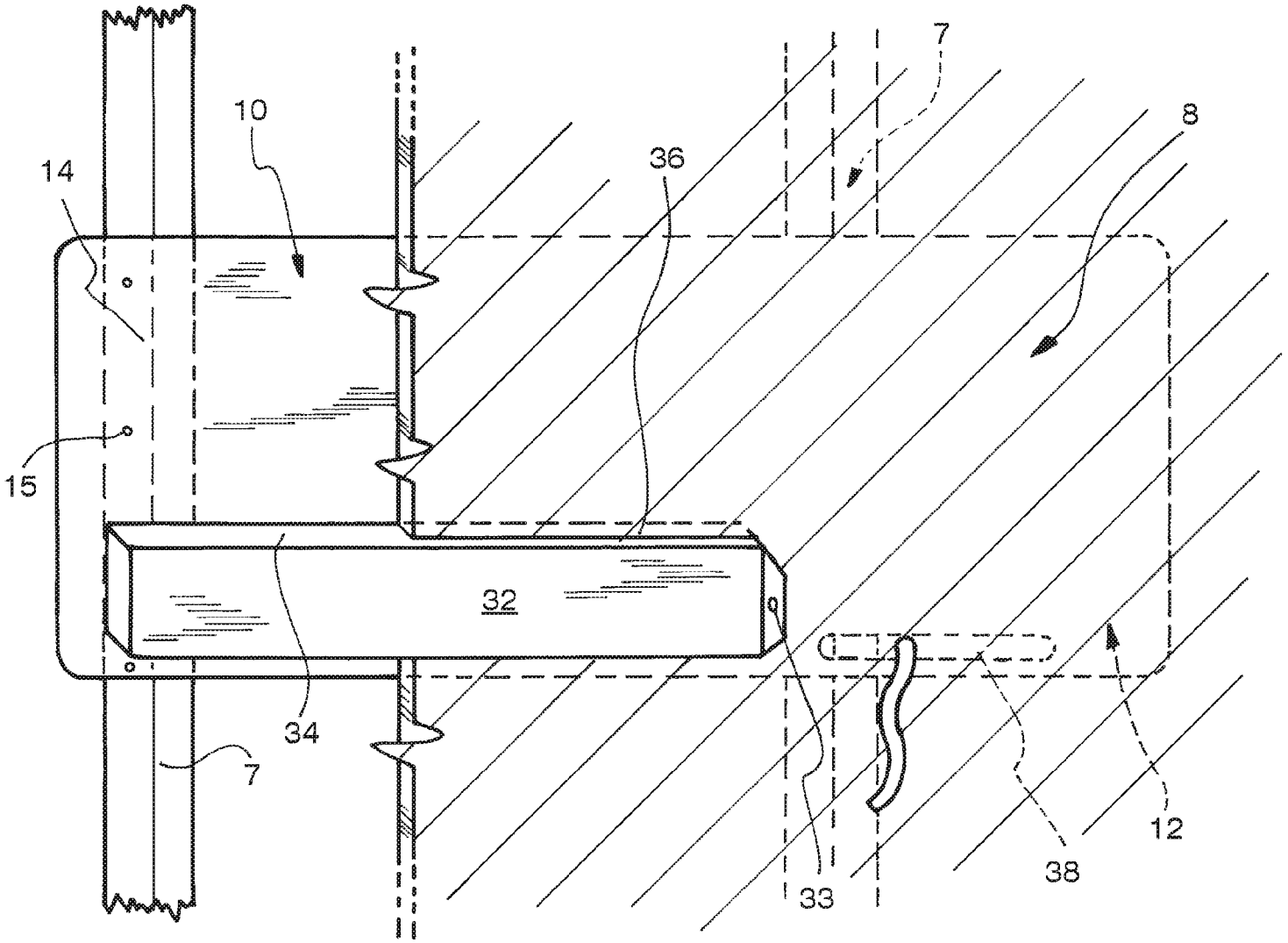
FIG. 4 is a perspective view of the mounting plate of FIG. 1 (with the cover of FIG. 3) partially covered by wall boards.

A housing 16 is located on the first side 12 (see FIG. 1). The housing can be formed of sheet metal and welded to the first side around side flaps 17. In use, the housing 16 is located between two or more wall studs 7. As shown in FIG. 4, where the housing 16 cannot be aligned between the wall studs 7 because of the positioning of the wall studs 7, the wall studs 7 can be cut into as required. The housing 16 is formed by a plurality of walls including a base 18 and side walls 22, 22 which in turn define a chamber 23. The housing 16 has a side opening 24 via which piping can be inserted into the chamber 23 of the housing 16. Once inserted, the piping rests in the housing 23 and is contained within the housing 16 by the base 18 and sides 22, 22.

Generally, conventional piping is formed of copper which allows the piping to flex to a limited degree to securely fit inside the chamber 23 of the housing 16 and remain in place. An advantage of the structure of the housing which can be provided is that the copper tubing used, though rigid, can be bent or manoeuvred into the housing such that, once inside, it limits the likelihood that inadvertent pulling of the piping will remove the piping from the housing. Hence, the housing 16 will provide sufficient hold to limit removal of the piping by inadvertent knocking of the piping (such as by builders during the construction process). The housing also has an access window 26. When installed, the access window 26 allows a user to access the piping housed in the housing 16 and connect it to an air conditioning unit.

In this embodiment, the mounting plate 10 further comprises a backing plate 31 located on the second side 14. The backing plate 31 is formed of 10 mm of a material of a thickness substantially equivalent to the wall boards 8. In this embodiment, the backing plate 31 is formed of a single layer of 10 mm of plaster.

In this embodiment, the housing 16 comprises a cover 32 (see FIG. 3) that blocks the access window 26. The cover 32 is an elongate member that has a first portion 34 that can be inserted into the housing 16 and a second portion 36 that rests upon a portion of the second side 14, over the backing plate 31. The first portion 34 is thicker than the second portion 36 such that, when the cover 32 is placed onto the mounting plate 10, the first portion 34 sits within the access window 26. The second portion 36 extends along a portion of the second side 14 over the backing plate 31.

In use, when positioning one or more wall boards 8, the cover 32 allows for an arrangement of the wall boards 8 such that the cover 32 is not covered by wall boards 8 and, hence, the access window 26 and backing plate 31 are not covered by wall boards 8. As shown in FIG. 4, a cut-out can be made in the wall board 8 corresponding in size and shape to the cover 32 which clearly defines the location of the piping and the backing plate 31 of the second side 14. There is sufficient space between the backing plate 31 and the air conditioning unit (when installed) to allow for the passage of the piping to the rear of the air conditioning unit. The cover 32 has side flaps 33 which can be used as securing points in which to secure the cover 32 to the mounting plate 10. Once the mounting plate 10 is installed, the cover 32 can be used as a general reference point to mark a predetermined location for the installation of a split bracket for the air conditioning unit. The split bracket can be mounted through the wall board 8 to the mounting plate 10 via appropriate screws.

The mounting plate has a second aperture 38 to allow one or more cables or electrical wires to be threaded through. The aperture 38 provides a specific reference point for the electrical fit off for the air conditioning unit.

In use, the first side 12 of the mounting plate 10 is attached to the wall studs 7. More particularly, the mounting plate 10 is attached between two wall studs 7. The mounting plate 10 is attached by screwing the mounting plate 10 to the wall studs 7 at an appropriate location with screws 15. Piping for the air conditioning unit is then placed into the housing 16 via opening 24 and electrical cables for the air conditioning unit are threaded through the aperture 38. In the embodiment shown, the wall boards 8 are installed to the wall studs 7, with a cut-out being made in the wall boards 8 around the cover 32. Once the cover 32 is removed, the piping is accessed through the access window 26 and connected to the air conditioning unit. The air conditioning unit is then mounted to a second side 14 of the mounting plate 10. It would be appreciated that, in alternate embodiments (such as those described below), use of the cover 32 would not be necessary, with wall boards 8 completely covering the access window 26 until a portion of the wall boards overlying the access window were cut out.

A second embodiment is shown in FIGS. 5 and 7 to 10.

A mounting plate 50 has a first side 52 adapted for attaching to a wall and a second side 54 (see, for example, FIG. 5) on which the air conditioning unit 70 (shown in FIG. 10) is mountable thereon. The wall comprises of wall studs 47 and wall boards 48 (see FIG. 8). The first side 52 can be connected to wall studs 47 and the second side 14 can be connected to wall boards 8.

A housing 56, similar to that of the first embodiment, is located on the first side 52. However, in this embodiment, the mounting plate 50 is substantially fire resistant. The fire resistance is obtained by the use of fire expandable foam 67 around an opening 64 of the housing 56. The foam 67 in this embodiment is intumescent or expandable graphite. The foam can be connected to the housing, around the opening 64 via a suitable adhesive. The interior of one or more side walls 62, 62 and base 68 of the housing 56 can also have a layer of a fire resistant board 69. The fire resistant board 69 is of fire retardant material such as calcium silicate sheet. In one example, the fire resistant board 69 can be connected to the interior of the one or more side walls 62, 62 via a suitable adhesive.

Figure 5:
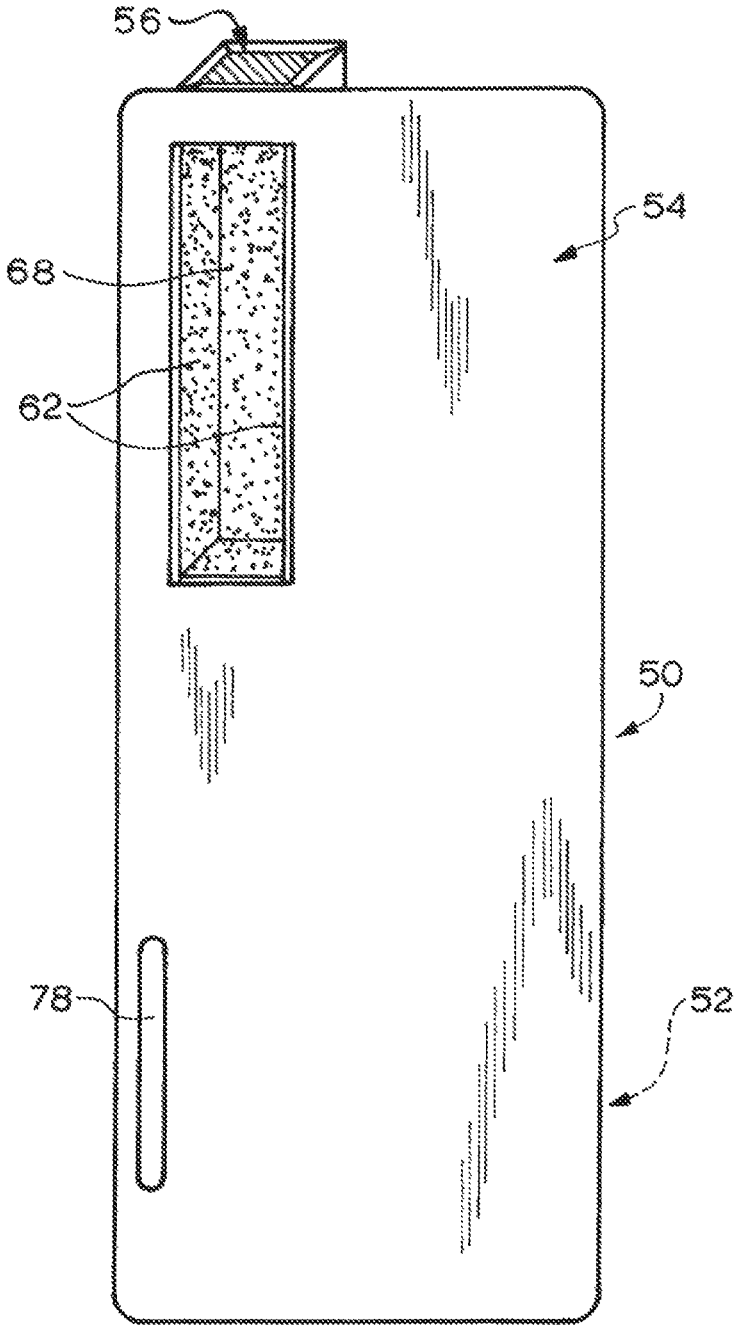
FIG. 5 is a perspective view of a second side of a mounting plate in accordance with a second embodiment of the invention having fire retardant characteristics.
Figure 6:
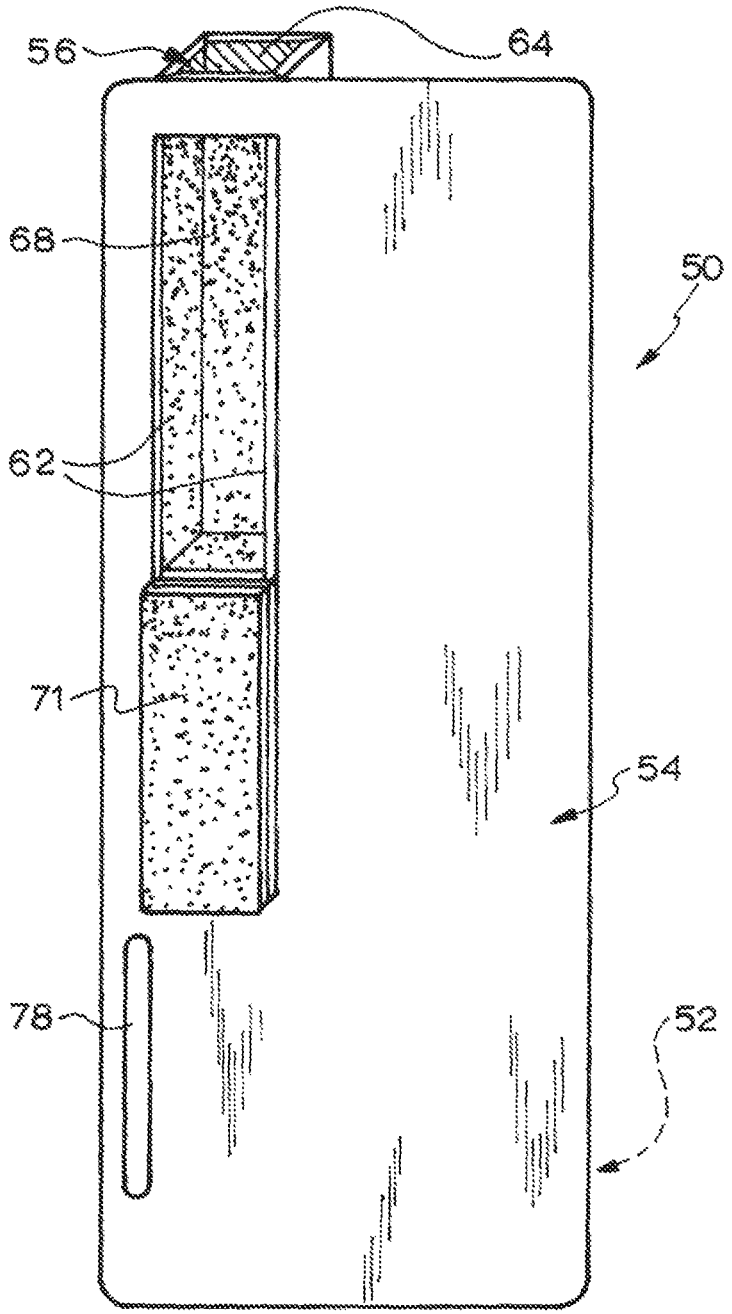
FIG. 6 is a perspective view of a second side of a mounting plate having a backing plate with fire retardant characteristics, in accordance with a third embodiment of the invention.
Figure 7:
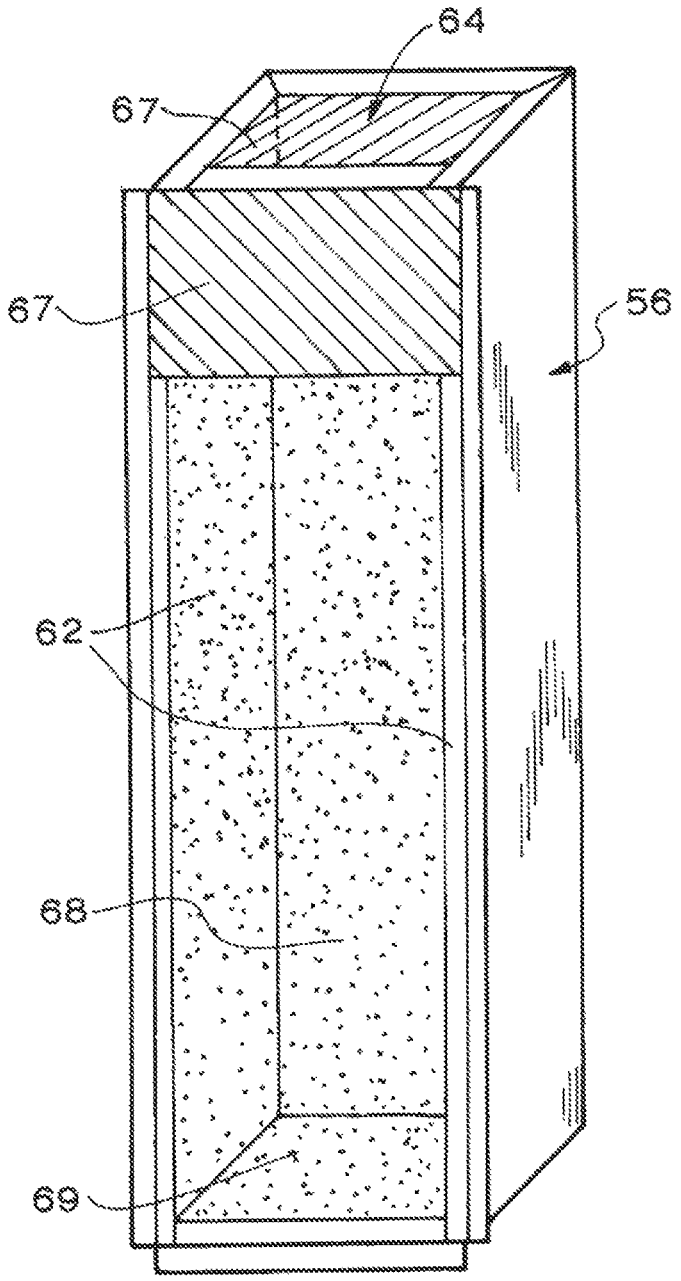
FIG. 7 is a more detailed view of a housing of the mounting plate of FIGS. 5 and 6 having fire retardant characteristics.
Figure 8:
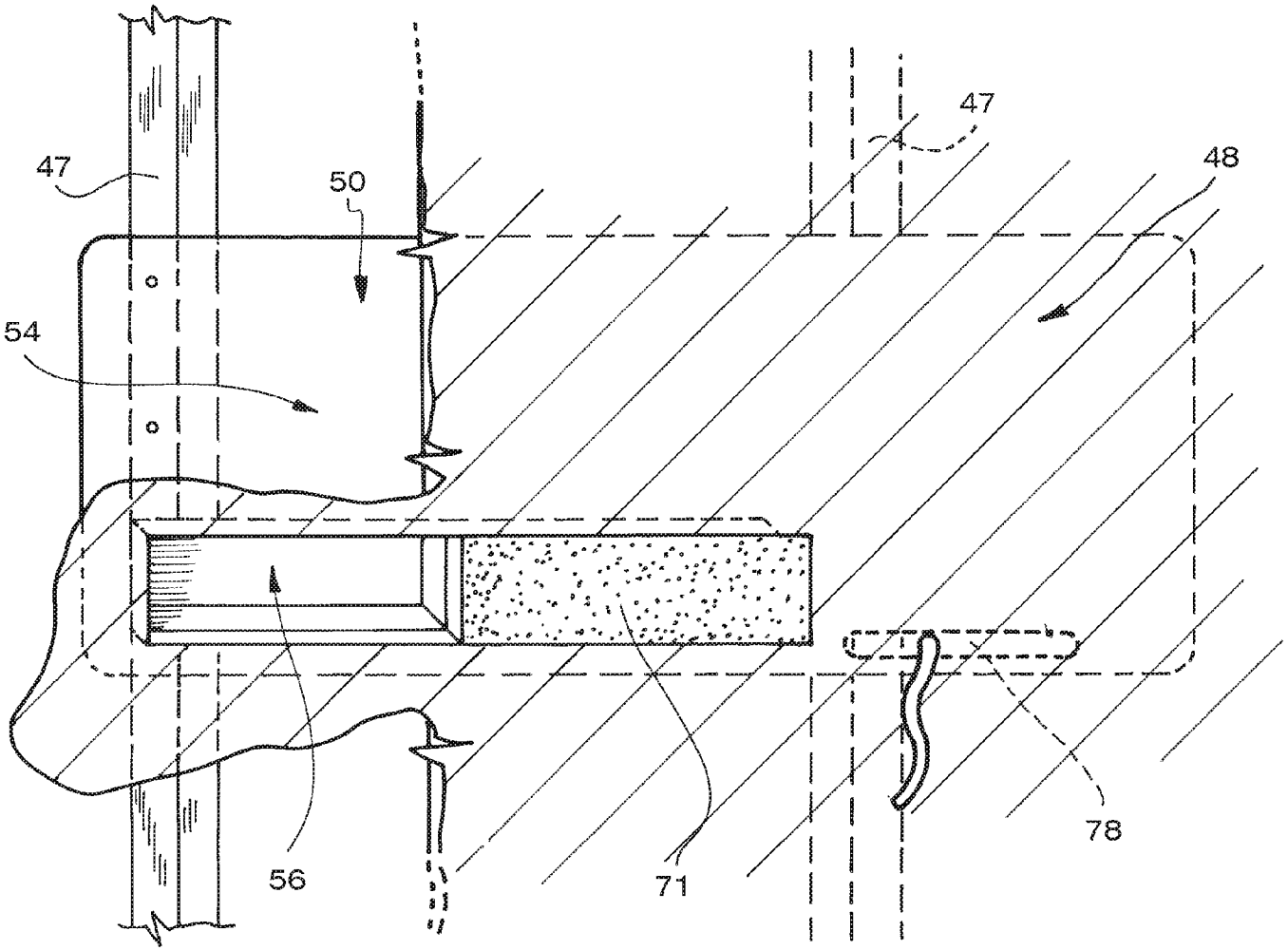
FIG. 8 is a perspective view of the mounting plate of FIG. 6 that is partially covered by wall boards.
Figure 9:
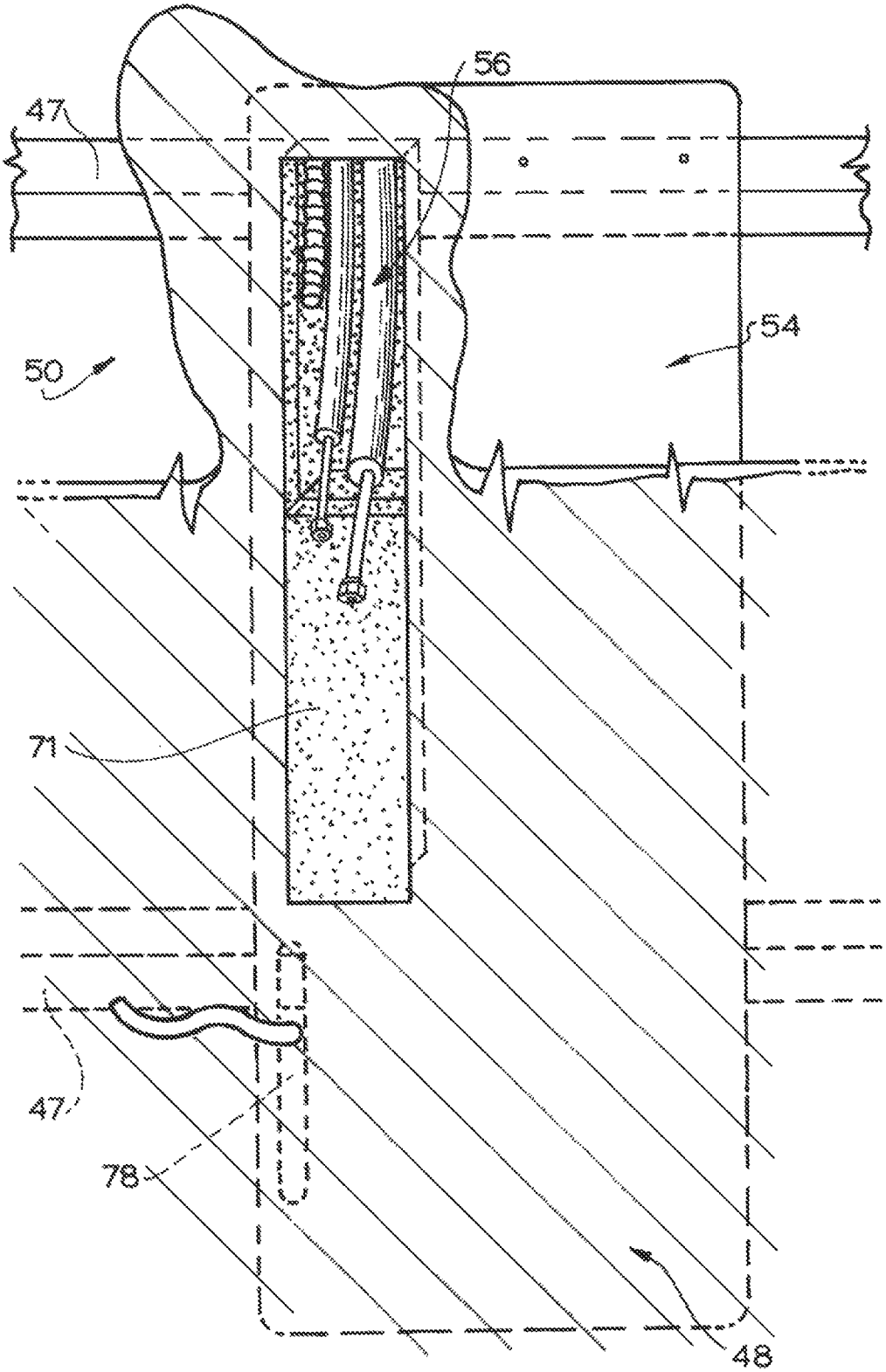
FIG. 9 is a perspective view of the mounted mounting plate of FIG. 8 having tubing in the housing.
Figure 10:
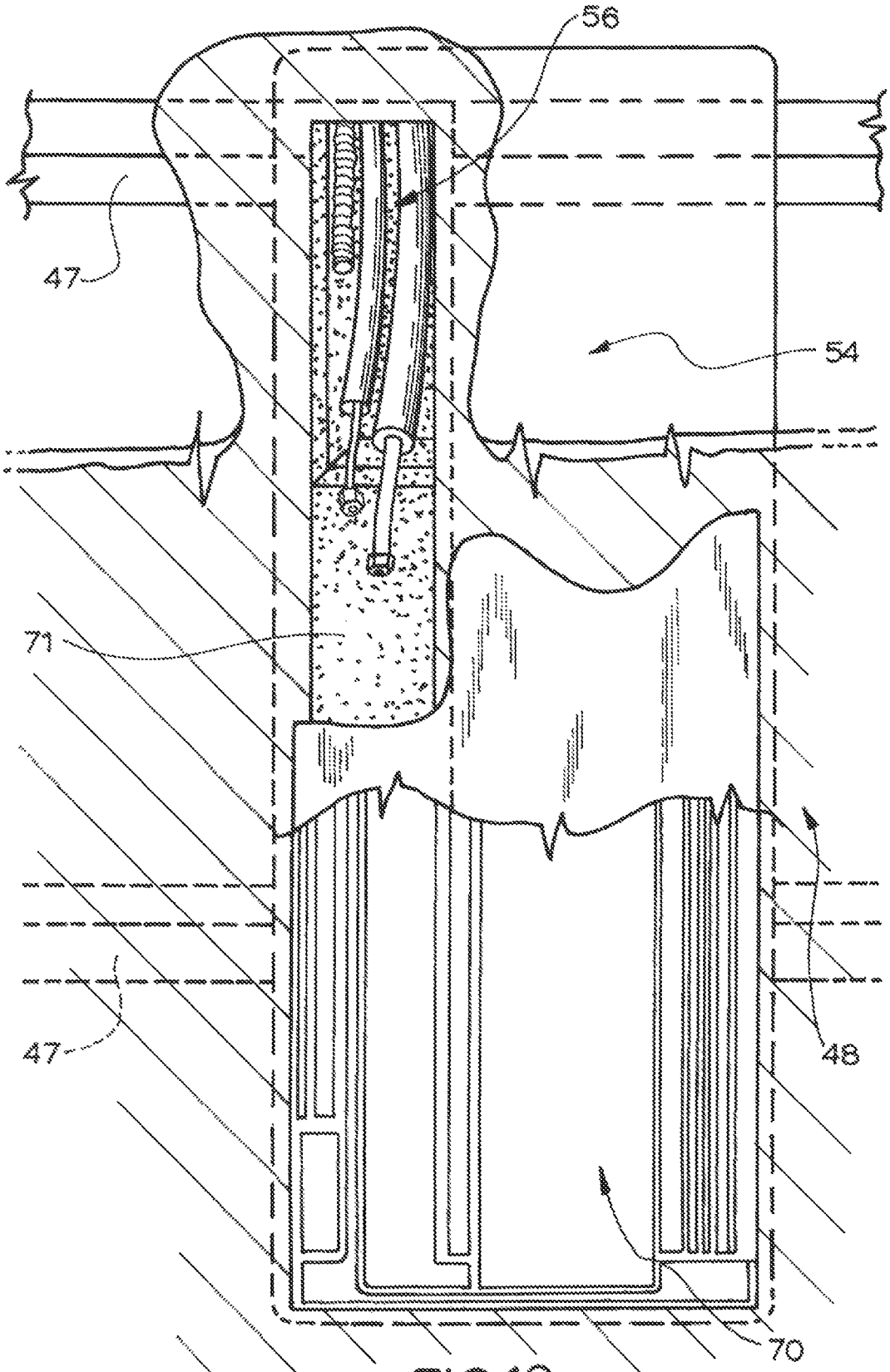
FIG. 10 is a perspective view of the mounted mounting plate of FIG. 9 with an air conditioning unit partially viewable.

In the second embodiment shown in FIG. 5, a backing plate is not used. In contrast, the third embodiment shown in FIG. 6 has a backing plate 71, located on the second side 54, formed of multiple sheets of fire retardant material (such as fire resistant board 69) or fire retardant material in combination with plaster. The backing plate 71 is formed of a material of a thickness substantially equivalent to the wall boards 48. Hence, this embodiment is used in combination with wall boards in the form of fire rated wall boards. In this embodiment, the backing plate 71 is formed of multiple sheets of 16 mm of fire resistant board 69.

A cover, similar to that in the first embodiment (shown in FIG. 3), can be suitably adapted for use with the embodiments shown in FIGS. 5 to 8.

The mounting plate 50 also has an aperture 78 to allow one or more cables or electrical wires to be threaded through.

Figure 11:
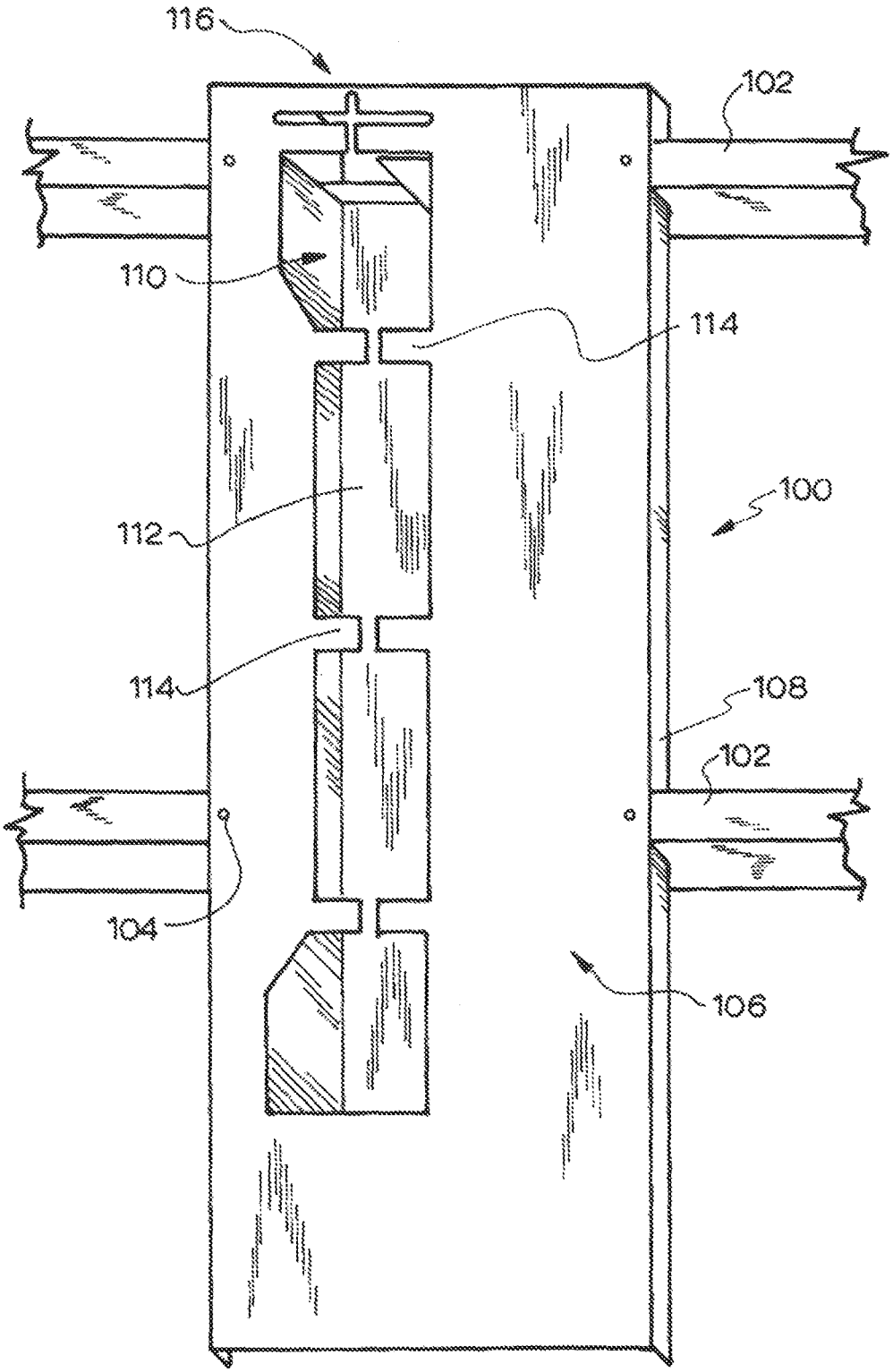
FIG. 11 is a perspective view of a second side of a mounting plate in accordance with a fourth embodiment of the invention mounted to wall studs.
Figure 12:
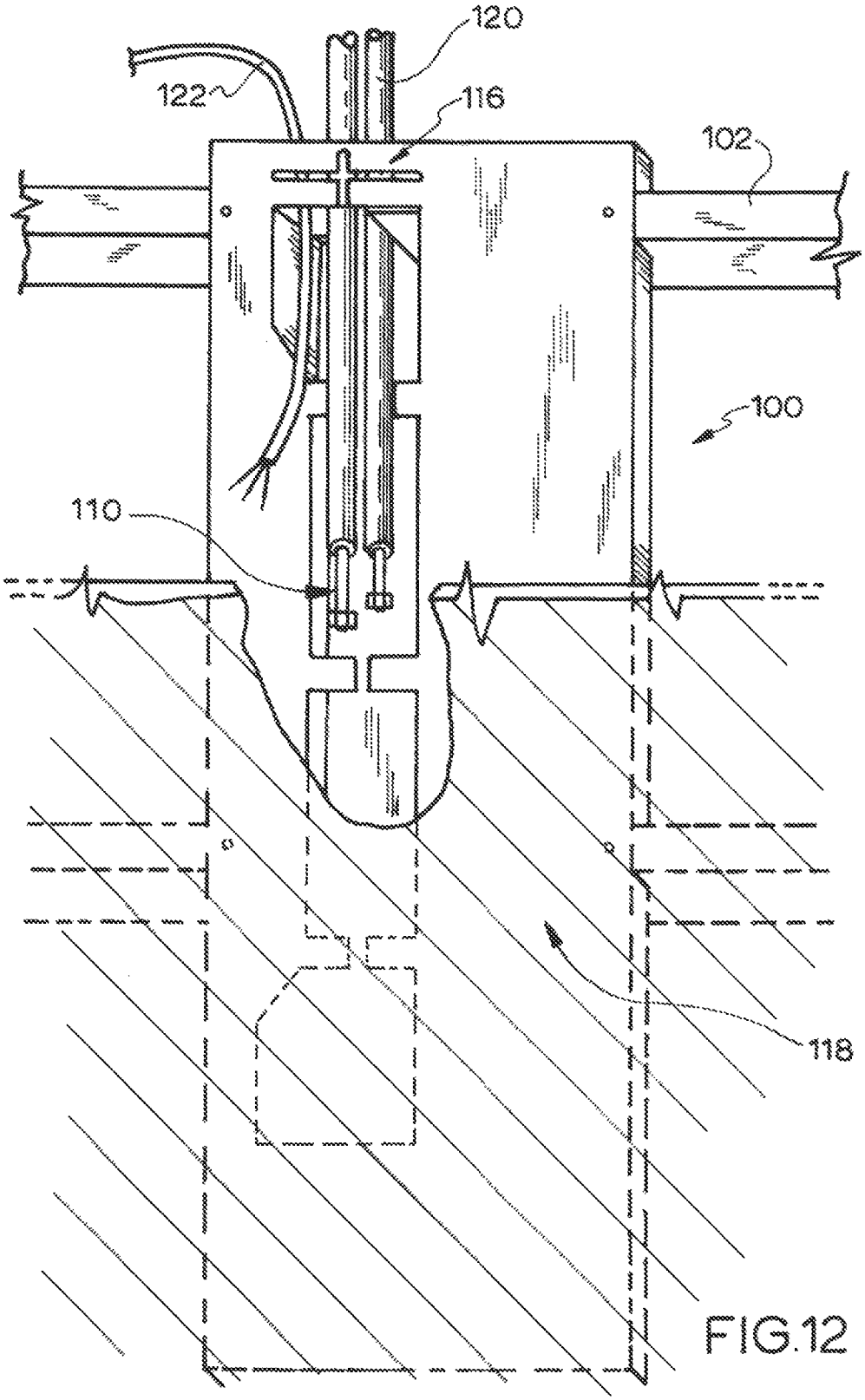
FIG. 12 is a perspective view of the mounted mounting plate of FIG. 11 having tubing in the housing and which is partially covered by wall boards.

A fourth embodiment of the invention is shown in FIGS. 11 and 12 in the form of mounting plate 100. Mounting plate 100 has a first side (which cannot be seen in the Figures) adapted for attaching to wall studs 102, 102, for example, with screws shown generally as screw 104. Mounting plate 100 also has a second side 106 which is completely flat so that wall boards (discussed below in relation to FIG. 12) can overlie the mounting plate 100, and in-folded portions shown generally at 108, which can help align the mounting plate 100 with respect to the wall studs 102, 102.

Mounting plate 100 also has a housing 110 which extends for a substantial portion of the width of the mounting plate 100 and spans wall studs 102 and 102. Although not shown, wall studs 102, 102 have had a portion cut from them to accommodate the housing 110, with the upper and lower cut ends of wall studs 102, 102 abutting the housing 110. Housing 110 can be accessed from the second side 106 via an access window 112 that extends for substantially the entire length of housing 110. Tabs 114, 114 can be provided at spaced intervals over the access window 112 in order to ensure that any piping etc. contained in the housing 110 cannot inadvertently fall out of the housing 110, where it might accidentally be damaged. Tabs 114, 114 can, however, easily be bent in the event that a person intentionally wants to enlarge the access window 112 (e.g. to access the piping during installation of the air conditioning unit). As would be appreciated, in this embodiment, a second aperture for receiving the electrical cable therethrough (e.g. second aperture 38 in FIG. 1) would not be required. Housing 110 also includes an opening 116 at one end thereof, via which piping and cables can be received from elsewhere in the wall cavity.

As housing 110 is longer than the corresponding housings in the embodiments described above, its internal volume is larger and it can therefore readily accommodate a greater length of piping etc. In embodiments where the housing is shorter, there may sometimes be a risk that the piping etc. either cannot fit, or must be bent back on itself in order to fit. Such embodiments would also typically require a cover be used to prevent the piping etc. from falling out of the housing. However, as would be appreciated, such a cover (even though it might be reusable numerous times) would require additional materials to make and potentially complicate the installation process (e.g. for trades people other than the air conditioner installer).

Although not shown, the interior of housing 110, etc. (and indeed, other parts of the mounting plate 100) can be provided with materials to improve the fire resistance properties of the mounting plate 100, as discussed above.

Referring now to FIG. 12, the mounting plate 100 is shown installed behind wall boards 118 and with the housing 110 containing piping 120 and an electrical cable 122. During installation, the installer would firstly install the mounting plate to the wall studs 102, 102 (i.e. as shown in FIG. 11) and then place the cables 120, 122 into the housing 110 via opening 116. The wall boards 118 would then be placed over the mounting plate 100 (and elsewhere in the room), plastered, painted, etc. before it was necessary for the installer to return for the second step of the installation process.

It is a relatively simple task for the installer to locate first the mounting plate 100 underneath the wall boards 118, and then the access window 112 (e.g. simply by taping the wall boards or by using tools such as stud finders or tools capable of locating metallic objects, where the mounting plate is made from a metallic material). Once the access window 112 is located, an aperture can be cut in the wall boards in order to access the cables 120, 122 in the housing 110 for attachment to the air conditioning unit (not shown). The air conditioning unit can then be mounted to the mounting plate 100, as discussed above.

As will be appreciated, embodiments of the mounting plate of the present invention can provide numerous advantages including (but not limited to):

a. Preventing damage of pipes from trades people on site during the construction process;

b. Reducing or eliminating damage to the wall board because the mounting plate, predefining the ideal position of the air conditioner, is installed prior to the wall board being installed;

c. Preventing the flow of fire, smoke, chemicals or the like through the pipes; and d. The use of a fire expandable foam in combination with a fire resistant board assists in achieving around about a 2 hour fire resistant rating.

Whilst there has been described herein particular embodiments of a mounting plate of the present invention, the described embodiments are considered in all respects only as illustrative and modifications can be made without departing from the spirit and scope thereof.

The words "comprise", "comprising" and grammatical variations thereof, when used in this specification and in the following claims, are intended to specify the presence of the recited features, but not preclude the addition of one or more other features, integers, components, steps or groups.

The invention claimed is:

1. A mounting plate for an air conditioning unit, the mounting plate comprising:

a first side for attachment to a wall having wall studs separating opposing wall boards and defining a wall cavity therebetween;

a second side on which the air conditioning unit is mountable; and an elongated housing extending from the first side, the elongated housing having a longitudinal axis positioned substantially horizontally and a side opening facing substantially transversely relative to the longitudinal axis, and wherein the elongated housing is sized to be completely positionable within the wall cavity when the mounting plate is affixed to the wall, the elongated housing defining a chamber to receive piping for attachment to the air conditioning unit, wherein the side opening has a height substantially coextensive with a height of the housing.

2. A mounting plate according to claim 1, wherein the chamber receives piping from within the wall cavity.

3. A mounting plate according to claim 1, wherein the mounting plate comprises an access window via which piping housed inside the housing can be accessed from the second side of the mounting plate.

4. A mounting plate according to claim 3, wherein the mounting plate comprises a cover having side flaps for securing the cover to the mounting plate.

5. A mounting plate according to claim 3, wherein the side opening is in fluid communication with the access window.

6. A mounting plate according to claim 5, wherein the side opening is substantially adjacent a lateral end of the mounting plate.

7. A mounting plate according to claim 1, wherein the mounting plate comprises a fire resistant material which resists the spread of fire through the mounting plate.

8. A mounting plate according to claim 1, wherein the housing comprises a fire resistant expandable foam.

9. A mounting plate according to claim 8, wherein the expandable foam is expandable graphite.

10. A mounting plate according to claim 8, wherein the expandable foam is located at an opening of the housing.

11. A mounting plate according to claim 1, wherein the housing comprises a fire resistant board.

12. A mounting plate according to claim 11, wherein the fire resistant board is a calcium silicate board.

13. A mounting plate according to claim 11, wherein an interior of the housing comprises a layer of the fire resistant board.

14. A mounting plate according to claim 1, wherein the housing has a width whereby it is positionable within the wall cavity between adjacent wall studs.

15. A mounting plate according to claim 1, wherein the housing is adapted to be positionable within the wall cavity and spanning one or more wall studs.

16. A mounting plate according to claim 1, wherein the mounting plate is sized and configured to mount an air conditioning unit.

17. A mounting plate for an air conditioning unit, the mounting plate comprising:

a first side for attachment to a wall having wall studs separating opposing wall boards and defining a wall cavity therebetween;

a second side on which the air conditioning unit is mountable; and an elongated housing permanently affixed to the first side, the elongated housing having a length extending substantially parallel to a length of the mounting plate, and wherein the elongated housing has a depth sized to be less than a depth of the wall cavity whereby the elongated housing is positionable within the wall cavity when the mounting plate is affixed to the wall, the housing being adapted to house piping from within the wall cavity for attachment to the air conditioning unit, the elongated housing having:

an access window via which piping housed inside the housing can be accessed from the second side of the mounting plate, and a side opening facing substantially transversely relative to the access window, wherein the side opening includes a depth substantially coextensive with the depth of the housing.

18. A mounting plate according to claim 17, wherein the side opening is substantially adjacent a side edge of the mounting plate.

19. A mounting plate for an air conditioning unit, the mounting plate comprising:

a first side for attachment to a wall having a wall cavity;

a second side on which the air conditioning unit is mountable;

a first access window and a second access window spaced from the first access window, wherein the second access window is elongated and sized to receive an electrical cord therethrough;

a plurality of holes for receiving connectors for attaching to a wall; and an elongated housing extending from the first side, wherein the elongated housing is sized to be completely positionable within the wall cavity when the mounting plate is affixed to the wall, the elongated housing having:

a longitudinal axis positioned substantially horizontally, a first opening adjacent to and in fluid communication with the first access window, and a second opening in fluid communication with the first opening.

20. A mounting plate according to claim 19, wherein the second access window extends parallel to and substantially in line with the elongated housing.

21. A mounting plate according to claim 19, wherein the second access window is spaced from the housing.

22. A mounting plate according to claim 19, wherein the first and second access windows are positioned in a plane defined by the mounting plate.

* * * * *